United States Patent [19]

Yasufuku

[11] 4,431,579

[45] Feb. 14, 1984

[54] METHOD OF IMPROVING ANTI-INFLAMMABILITY OF DIMETHYL SILICONE OIL FOR USE IN STATIC ELECTRIC APPARATUS

[75] Inventor: Sachio Yasufuku, Fujisawa, Japan

[73] Assignee: Tokyo Shibaura Denki Kabushiki Kaisha, Kawasaki, Japan

[21] Appl. No.: 373,677

[22] Filed: Apr. 30, 1982

[30] Foreign Application Priority Data

May 11, 1981 [JP] Japan ..... 56-70494

[51] Int. Cl.[3] ..... H01B 3/46

[52] U.S. Cl. ..... 252/573; 174/110 S; 174/137 B; 252/49.7; 260/429 J; 336/94; 361/327; 556/450

[58] Field of Search ..... 252/573, 49.7; 556/450; 260/429 J; 174/110 S, 137 B; 336/94; 361/327

[56] References Cited

U.S. PATENT DOCUMENTS

| | | | |
|---|---|---|---|
| 2,446,135 | 7/1948 | Hyde | 556/450 |
| 2,452,254 | 10/1948 | McGregor et al. | 556/450 |
| 2,452,416 | 10/1948 | Wright | 556/450 |
| 3,008,901 | 11/1961 | Baker et al. | 252/49.7 |
| 3,267,036 | 8/1966 | Baker et al. | 252/49.7 |
| 4,146,491 | 3/1979 | Vincent | 174/110 S |

OTHER PUBLICATIONS

General Electric Technical Data Book S-90, Silicones-Fluids, Aug. 1970.

Chemical Abstracts, vol. 90, No. 4, 22 Janvier 1979, p. 34, No. 24219n, Columbus, Ohio, US and JP-A-78 65400 (Toshiba Silicone Co., Ltd.) 10-06-1978.

*Primary Examiner*—John E. Kittle
*Assistant Examiner*—Robert A. Wax
*Attorney, Agent, or Firm*—Oblon, Fisher, Spivak, McClelland & Maier

[57] ABSTRACT

The anti-inflammability of dimethyl silicone oil for use in static electric apparatuses is improved by reacting the dimethyl silicone oil with a cerium chelate compound so as to bind thereto a predetermined amount of the cerium chelate compound. This binding suppresses the generation of the cyclic oligomer components to be produced by the decomposition of dimethyl silicone oil, thereby elevating the flash point of the dimethyl silicone oil.

3 Claims, No Drawings

METHOD OF IMPROVING ANTI-INFLAMMABILITY OF DIMETHYL SILICONE OIL FOR USE IN STATIC ELECTRIC APPARATUS

BACKGROUND OF THE INVENTION

I. Field of the Invention

The present invention relates to a method of improving the anti-inflammability of dimethyl silicone oil for use in static electric apparatuses.

II. Description of the Prior Art

Polychlorinated biphenyls (PCBs) have heretofore been used as insulating oils for transformers or as fire-retardant dielectric liquid for high-voltage capacitors. As PCBs cause environmental pollution exerting an adverse influence on human bodies, dimethyl silicone oils are currently used in place thereof. Dimethyl silicone oils exhibit superior heat resistance and favorable electrical insulating characteristics and they have a high flash point and a short fire duration. Therefore, they have superior properties as oils for use in static electric apparatuses. It is recognized that an open flash point of 300° C. or higher is one of the important properties which fire-retardant dielectric liquids must have.

As further demand for fire retardation has been raised for static electric apparatuses, fire-retardant dielectric liquids or oils having higher flash points or slower fire propagation rates have been strongly desired.

It is to be noted that there is such a relationship between kinematic viscosities and flash points of dimethyl silicone oils as shown in Table A.

TABLE A

| Kinematic viscosities and flash points of dimethyl silicone oils | |
|---|---|
| Kinematic Viscosity (cSt, 25° C.) | Flash Point (°C.) |
| 5 | 149 |
| 20 | 210 |
| 50 | 308 |
| 100 | 330 |
| 350 | 349 |
| 1,000 | 343 |

It appears from Table A that the elevation of the kinematic viscosity of dimethyl silicone oils will result in a higher flash point. It is not desired, however, to raise the kinematic viscosity of dimethyl silicone oils too high because such a high kinematic viscosity will adversely affect its cooling capability in static electric apparatuses and its impregnability into impregnable insulating base materials such as insulating paper to be used in static electric apparatuses.

SUMMARY OF THE INVENTION

Therefore, an object of the present invention is to provide a method of improving the anti-inflammability of dimethyl silicone oils without causing a considerable decrease in its other performances.

In accordance with the present invention, there is provided a method of improving the anti-inflammability of dimethyl silicone oil for use in static electric apparatuses, which comprises reacting dimethyl silicone oil for use in a static electric apparatus having a kinematic viscosity ranging from 47.5 to 52.5 centistokes at 25° C. with a chelate compound of cerium, and chemically combining the cerium compound with the dimethyl silicone oil in an amount sufficient to prevent the generation of cyclic oligomer components due to the decomposition of the dimethyl silicone oil. The method according to the present invention can provide dimethyl silicone oil having a higher flash point without its electric insulating performance being impaired to any great extent.

It was not known so far how dimethyl silicone oil is ignited. It was generally considered that the inflammability and combustibility of dimethyl silicone oil were dependent upon volatilization of low molecular weight oligomers present therein; heat energy required for the thermal decomposition of dimethyl silicone oil into the oligomers; and the vapor pressure, chemical composition and thermal decomposibility of individual molecules constituting the dimethyl silicone oil.

As a result of extensive studies on the inflammation of dimethyl silicone oil, it has been found that the inflammability is dependent upon the cyclic oligomers, having low boiling points, of decomposition products of dimethyl silicone oil, such as hexamethyl cyclotrisiloxane ($(CH_3)_2SiO)_3$ (hereinafter referred to as $D_3$), octamethyl cyclotetrasiloxane ($(CH_3)_2SiO)_4$ (hereinafter referred to as D4) and the like. It was accordingly found that the anti-inflammability of dimethyl silicone oil can be improved by preventing the cyclic oligomers from being produced, and the present invention is based on this finding.

DETAILED DESCRIPTION OF THE PREFERRED EMBODIMENTS

Dimethyl silicone oil for use in static electric apparatuses to be treated according to the present invention is one having a kinematic viscosity ranging from about 47.5 to about 52.5 centistokes (cSt) at 25° C. Where the kinematic viscosity exceeds about 52.5 cSt, its cooling capability in static electric apparatuses in which dimethyl silicone oil is used is decreased and impregnability into impregnable insulation base material such as insulation paper to be used in the static electric apparatuses is also impaired. Where its kinematic viscosity falls below about 47.5 cSt, the flash point of the dimethyl silicone oil is not elevated to the extent required for safe operation of the static electric apparatuses. As is well known to those skilled in the art, dimethyl silicone oil may be manufactured by the co-hydrolysis and polycondensation of dimethyl dichlorosilane and trimethyl monochlorosilane or, or an industrial scale, by the ring-cleavage polymerization of octamethyl cyclotetrasiloxane and hexamethyl disiloxane (see Encyclopedia of Chemical Technology, Chapter "Silicones" 2nd Revised Edition (1969), page 221 et seq., particularly see page 224).

The present inventor has investigated various additives for the purpose of this invention in which the generation of the cyclic oligomers, having low boiling points, from dimethyl silicone oil is suppressed. In such investigation, the following requirements are also taken into consideration: (i) not to cause a decrease in the cooling capability and impregnability of dimethyl silicone oil, that is, to cause no increase in a kinematic viscosity thereof; (ii) not to color and denature dimethyl silicone oil; (iii) not to cause a considerable decrease in the electrical insulating properties of dimethyl silicone oil, and (iv) not to produce solid materials such as precipitates in dimethyl silicone oil, as such solid materials may damage the devices.

As a result, it was found that the reacting and combining of a chelate compound of cerium with the di- ıethyl silicone oil can satisfy all the above require-ıents, thus suppressing the generation of the low boil-ıg point cyclic oligomers and improving the anti-ıflammability of the dimethyl silicone oil.

The cerium chelate compound to be used according ) the present invention includes, for example, Ce(III) :etylacetonate, Ce(IV) acetylacetonate and CE(IV) asic acetylacetonate.

The reaction of the cerium chelate compound with imethyl silicone oil may be carried out in accordance 'ith a procedure described, for example, in Japanese atent Application Disclosure No. 53-65,400. This pro-:dure involves a two-step process. The first step is to repare a dispersion or a solution containing a relatively igh content of a cerium chelate compound (for exam-le, 2% by weight) by adding the cerium chelate com-ɔund to dimethyl silicone oil to be used for the present ıvention at 70° to 80° C. The second step is to gradu-ly add the dispersion or solution to a separately pre-ared dimethyl silicone oil at a temperature ranging om 200° to 300° C., preferably from 240° to 280° C., hile air or oxygen is continuously flowed thereinto. his process produces modified dimethyl silicone oil hich is transparent without any solid material and ɔmogeneous in quality. This modified dimethyl sili-ɔne oil has the same kinematic viscosity as the corre-ıonding non-modified dimethyl silicone oil.

The amount of the cerium chelate compound to be troduced into and chemically combined with the di-ethyl silicone oil should be sufficient to prevent the :neration of the low boiling point cyclic oligomers ıch as the $D_3$ and $D_4$ components. It is to be noted, ɔwever, that the amount thereof should also not be :cessive to the extent of damaging the electrical insu-ting properties of dimethyl silicone oil to any great :gree. Specifically, the amount may range from 55 to ; ppm, preferably from 60 to 70 ppm in terms of the :rium content. Where the cerium concentration is :low 55 ppm, the effect of improving the anti-inflamm-ıility is poor. In this case, the flash point will be ele-ıted by less than 10° C. when compared to the non-odified oil. Where the cerium content is over 75 ppm, ı the other hand, the effect of improving the anti-flammability as well as the electrical insulating perfor-ance begin decreasing.

As stated above, dimethyl silicone oil reacts with a edetermined amount of a cerium chelate compound, ereby improving the anti-inflammability of the di-ethyl silicone oil. This is because low boiling point 'clic oligomers such as the $D_3$ and $D_4$ components can : produced by repeatedly separating $-Si(CH_3)_2-OH$ oup from each dimethyl silicone molecule and then owing for ring closure of the molecule. The cerium ıelate compound reacts and combines with the termi-l OH groups existing in the dimethyl siloxane mole-le, thereby preventing the production of the low ıiling point cyclic oligomers and thus improving the ti-inflammability of the dimethyl silicone oil. The :roduction of the cerium chelate compound also im-oves the thermal stability of dimethyl silicone oil.

The modified dimethyl silicone oil having improved ti-inflammability prepared according to the present vention can be used in a static electric apparatus such a transformer or a high-voltage capacitor. It exhibits cellent anti-inflammability, thermal stability, impreg-bility, cooling capability and electrical insulating aracteristics. The modified dimethyl silicone oil is ıwer in fire propagation rate than the non-modified dimethyl silicone oil, and it has many advantages for use in static electric apparatus.

The present invention will now be described in more detail by way of examples in comparison with control examples.

EXAMPLES 1-5 AND CONTROLS 1-6

To dimethyl silicone oil having a kinematic viscosity of 50 cSt at 25° C. was added cerium acetyl acetonate hydrate ($Ce(acac)_3 \cdot H_2O$) at 70° to 80° C. to prepare a solution containing the cerium compound in the amount of about 2% by weight. This solution was added dropwise to another portion of dimethyl silicone oil having a kinematic viscosity of 50 cSt at 25° C., at 250° C., while air was flowed into the silicone oil portion to prepare modified dimethyl silicone oils having different cerium contents in ppm by weight as shown in Table 1. The quantitative analysis of cerium was carried out as follows: a specimen was heated to ash which was in turn dissolved in a mixture of hydrofluoric acid and sulfuric acid and diluted with a predetermined amount of water after evaporation, and the specimen was then subjected to an inductively coupled argon plasma emission spectrophotometric analysis using Model ICAP-1000 (manufactured by Japan Jarrell-Ash Co.) with an ammonium ceric sulfate standard solution.

The flash points and fire propagation rates of thus prepared modified dimethyl silicone oils and the non-modified dimethyl silicone oils were measured in accordance with JIS-C 2101. The results are shown in Table 1.

TABLE 1

| Cerium Concentration (ppm) | Flash Points (°C.) | Fire Propagation Rates (mm/sec) |
|---|---|---|
| 0 (Control 1) | 320 | 1.2 |
| 50 (Control 2) | 329 | 0.9 |
| 55 (Example 1) | 332 | 0.6 |
| 60 (Example 2) | 335 | 0.6 |
| 65 (Example 3) | 336 | 0.6 |
| 70 (Example 4) | 335 | 0.6 |
| 75 (Example 5) | 332 | 0.6 |
| 80 (Control 3) | 330 | 0.7 |
| 100 (Control 4) | 330 | 0.8 |
| 200 (Control 5) | 327 | 1.0 |
| 500 (Control 6) | 324 | 1.0 |

It is apparent from Table 1 that, where the cerium concentrations range from 55 to 75 ppm, the flash points and fire propagation rates are improved. It was also found from measurement of the electrical insulating performance that the modified dimethyl silicone oils of Controls 5 and 6 were not suitable for use in static electric apparatuses due to a considerable decrease in the performance. Table 2 shows the electrical insulating performance of the modified dimethyl silicone oil of Example 4.

TABLE 2

| | |
|---|---|
| Dielectric constant (50 Hz, 25° C.) | 2.70 |
| Dielectric dissipation factor (%) (50 Hz, 25° C.) | 0.50 |
| Volume resistivity (Ω . cm) (25° C.) | $1 \times 10^{14}$ |
| Dielectric breakdown voltage (kV/2.5 mm) (25° C.) | 35 |

It was confirmed from pyrolysis gas chromatography-mass spectrometry that the amounts of the cyclic oligomers, particularly the $D_3$ and $D_4$ components, were decreased to a great extent by the addition of the cerium compound, as shown in Table 3 below.

TABLE 3

| | Weight Loss on Heating (% by weight) | Amount of $D_3$ Produced (% by weight) | Amount of $D_4$ Produced (% by weight) |
|---|---|---|---|
| Modified dimethyl silicone oil (Example 4) | 0.63 | 0.31 | 0.11 |
| Non-modified dimethyl silicone oil (Control 1) | 4.72 | 0.90 | 0.26 |

Note: Measurement was made after heating at 300° C. in air for 10 minutes.

What is claimed is:

1. A method of improving the anti-inflammability of dimethyl silicone oil which is used in the manufacture of static electric apparatus, comprising:

reacting dimethyl silicone oil normally used as a fire retardant dielectric liquid in static electric devices and having a kinematic viscosity ranging from 47.5 to 52.5 centistokes at 25° C. with a cerium chelate compound selected from the group consisting of Ce(I) acetylacetonate, Ce(IV) acetylacetonate and Ce(IV) basic acetylacetonate; and chemically combining the cerium chelate compound with the dimethyl silicone oil in an amount of 55 to 75 ppm, calculated in terms of cerium, which is an amount sufficient to prevent the generation of cyclic oligomer components in said oil which form upon decomposition of the dimethyl silicone oil, whereby the flashpoint of the dimethyl silicone oil is elevated without impairing the electrical insulating performance of said oil.

2. The method of claim 1, wherein the amount of said cerium chelate compound ranges from 60 to 70 ppm.

3. The method of claim 1, wherein said product dimethyl silicone oil has a flashpoint of at least 329° C.

* * * * *